US008875923B2

(12) United States Patent
Koo et al.

(10) Patent No.: US 8,875,923 B2
(45) Date of Patent: Nov. 4, 2014

(54) IDENTIFICATION ATTACHMENTS

(75) Inventors: Yeong-Heng Koo, Auckland (NZ); Andrew Nicholson Wrigley, Auckland (NZ)

(73) Assignee: ITW New Zealand Limited, Auckland (NZ)

( * ) Notice: Subject to any disclaimer, the term of this patent is extended or adjusted under 35 U.S.C. 154(b) by 1439 days.

(21) Appl. No.: 12/065,642

(22) PCT Filed: Sep. 29, 2006

(86) PCT No.: PCT/IB2006/002704
§ 371 (c)(1),
(2), (4) Date: Mar. 4, 2008

(87) PCT Pub. No.: WO2007/042879
PCT Pub. Date: Apr. 19, 2007

(65) Prior Publication Data

US 2008/0230509 A1 Sep. 25, 2008

(30) Foreign Application Priority Data

| | | |
|---|---|---|
| Oct. 10, 2005 | (NZ) | 542950 |
| Mar. 23, 2006 | (NZ) | 546095 |
| Aug. 11, 2006 | (NZ) | 542950 |

(51) Int. Cl.
*G09F 3/08* (2006.01)

(52) U.S. Cl.
USPC ..... 215/386; 340/572.1; 40/306; 40/642; 40/310; 137/382; 220/727; 215/387

(58) Field of Classification Search
USPC ..... 215/386, 387; 137/296, 382; 70/164, 70/165, 57.1; 40/306; 340/572.1
See application file for complete search history.

(56) References Cited

U.S. PATENT DOCUMENTS

| | | | | |
|---|---|---|---|---|
| 4,827,643 | A * | 5/1989 | Hearst et al. | 40/306 |
| 5,539,188 | A | 7/1996 | Fallah et al. | |
| 5,555,655 | A * | 9/1996 | Yager et al. | 40/306 |
| 6,247,491 | B1 * | 6/2001 | Petryna | 137/382 |
| 6,463,953 | B1 * | 10/2002 | Cuzzo et al. | 137/296 |
| 6,691,732 | B2 * | 2/2004 | Fleury et al. | 137/296 |
| 2008/0030334 | A1 * | 2/2008 | Marsilio et al. | 340/572.1 |

FOREIGN PATENT DOCUMENTS

FR 2685519 A1 6/1993

OTHER PUBLICATIONS

ISR for PCT/IB2006/002704 mailed Apr. 25, 2007.

* cited by examiner

*Primary Examiner* — Anthony Stashick
*Assistant Examiner* — Cynthia Collado
(74) *Attorney, Agent, or Firm* — Lowe Hauptman & Ham LLP

(57) ABSTRACT

This invention provides an attachment for mounting electromagnetic identification tags onto the necks of bottles. The tag has a portion which provides a receptacle portion for an RFI tag. This receptacle portion is connected to a portion that embraces a neck of a bottle to attach the receptacle portion, and thereby, the RFID tag to the neck of the bottle. The identification tag may be formed from a material that does not interfere with electromagnetic signals.

35 Claims, 9 Drawing Sheets

IDENTIFICATION ATTACHMENTS

RELATED APPLICATIONS

The present application is based on International Application Number PCT/IB2006/002704 filed Sep. 29, 2006, and claims priority from New Zealand Application Number 542950 filed Aug. 11, 2006, New Zealand Application Number 546095 filed Mar. 23, 2006 and New Zealand Application Number 542950 filed Oct. 10, 2005, the disclosures of which are hereby incorporated by reference herein in their entirety.

TECHNICAL FIELD

The present invention relates to identification attachments for attaching electromagnetic tags to bottles. In particular, it relates to identification attachments for attaching electromagnetic identification tags to necks of bottles. Further in particular it relates to identification attachments for attaching electromagnetic tags to metallic necks of bottles.

BACKGROUND ART

Radio frequency identification ("RFID") technology involves data being read from a radio frequency tag by a radio frequency reader. RFID technology allows quick and convenient reading of identification data as the data is read without any need for physical contact between the reader and the tag. Also, the identification data is read by the reader directly into an electronic form, which can further add to the convenience of the technology.

One application for RFID tag technology is the maintenance of inventories of gas bottles. Conventionally, printed labels are used to display an identification code for the bottles. A problem with this approach is that gas bottles tend to be relatively bulky and the not easily moved as required sometime to read their labels.

Therefore, RFID tag technology may provide a more convenient identification mechanism than printed labels as the RFID reader might need only be waved near the tag. A problem associated with the use of RFID technology for gas bottles is that the gas bottles are often metallic and may obstruct, reflect or attenuate the radio frequency signals used by the reader. This is particularly likely if the tag is on an opposite side of a metallic neck of the bottle from the reader.

It has been identified by the applicant that an attachment for gas bottles is required which overcomes some of the problems associated with the use of radio frequency technology around metallic bottles and which allows convenient, and possible replaceable, attachment of radio frequency identification tags to the bottles.

Accordingly, it is an object of the present invention to provide an identification attachment for a bottle that has metallic outlet components the attachment allowing convenient attachment of a radio frequency identification tag to the bottle, or at least to provide the public with a useful choice in identification attachments.

It is the further object of the present invention to provide an identification attachment for a bottle with metallic outlet components which conveniently attaches and maintains a radio frequency identification tag in a given position relative to the outlet components so that some of the effects that the metallic outlet component will have on radio frequency transmissions might be mitigated, or at least to provide the public with a useful choice in identification attachments.

It is an object of the present invention to provide an attachment for a bottle that provides a protected environment for radio frequency identification tags, or at least provide the public with a useful choice in identification attachments for bottles.

As used herein the term 'receptacle' refers broadly to an object or part of an object that receives another object.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

DISCLOSURE OF INVENTION

According to the first aspect of the present invention there is provided an electromagnetic identification tag to a bottle having a neck, the identification attachment including:

a receptacle portion adapted to receive an electromagnetic identification tag; and an embracing portion connected to the receptacle portion and adapted to embrace a neck of a bottle so as to mount the receptacle portion onto the neck of the bottle.

Preferably, the receptacle portion is substantially cantilevered from the embracing portion when the embracing portion embraces the neck of a bottle.

Preferably, the embracing portion includes a hinged portion adapted to allow the embracing portion to open and admit the neck of a bottle into the embracing portion.

Preferably, the embracing portion includes a hinge closure adapted to hold the embracing portion closed.

Preferably, the hinge closure is adapted to provide tamper evident closure of the hinged portion.

Preferably, the hinge closure includes at least one latch.

Preferably, the hinge closure includes at least one latch located substantially at each of an end of the hinged portion.

Preferably, the identification attachment includes a securing surface adapted to bear against a surface substantially parallel to the neck of the bottle.

Preferably, the securing surface is adapted to secure the identification attachment against rotation around the neck of the bottle.

Preferably, the securing surface is a flat surface arranged substantially perpendicular to the embracing portion.

Preferably, the securing surface is positioned substantially at an edge of the embracing portion.

Preferably, the securing surface is substantially aligned with the receptacle portion.

Preferably, the receptacle portion defines a recess.

Preferably, the recess is substantially cylindrical.

Preferably, the identification attachment includes a recess closure member which is fixable over the recess.

Preferably, the recess closure member is adapted to be inserted into the recess so as to close the recess.

Preferably, the recess and recess closure member are adapted so that the recess closure member is capable of being inserted into the recess by a press.

Preferably, the recess and/or recess closure portion are provided at least one ridge.

Preferably, the identification attachment includes at least one ridge is arranged so as to provide friction between the sides of the recess and the closure portion in the recess.

Preferably, the identification attachment includes at least one thread engaging element adapted to engage a thread formed on the neck of the bottle.

Preferably, the thread engaging element is formed on the embracing portion.

Preferably, the identification attachment includes a plurality of thread engaging elements disposed about the embracing portion.

Preferably, the identification attachment includes at least one thread engaging element includes at least one thread engaging projection which projects towards the neck of the bottle in use.

Preferably, the identification attachment includes at least one thread engaging projection is substantially aligned with a thread formed around the neck of the bottle.

Preferably, the identification attachment includes at least one thread engaging element includes at least one filament arranged to bear against the neck of the bottle.

Preferably, the identification attachment includes at least one filament is adapted to deform to the profile of the neck with pressure provided by the embracing portion.

Preferably, the filament is adapted to deform to a longitudinal profile of the neck of the bottle.

Preferably, the identification attachment includes at least one filament formed as a ridge on a surface of the embracing portion.

Preferably, the identification attachment includes a compressible element adapted to be received in the receptacle portion with the electromagnetic tag.

Preferably, the compressible element is adapted to compress to substantially fill parts of the receptacle portion not filled by the identification tag.

Preferably, the receptacle portion is formed substantially from plastic material.

Preferably, the receptacle portion is adapted to receive an electromagnetic tag in the form of a radio frequency identification tag.

Preferably, the recess includes at least one protrusion adapted to locate the identification tag in the recess.

Preferably, the identification attachment includes at least one protrusion is adapted to limit movement of the recess closure member into the recess.

Preferably, at least a portion of the identification attachment is formed from material that is substantially transparent to radio frequency radiation.

Preferably the embracing portion is shaped to define an enclosed region when the embracing portion is closed.

Preferably this enclosed region is substantially cylindrical having a predefined depth.

Preferably the hinged portion extends approximately half way around the embracing region.

Preferably the hinge closure is adapted to resist the hinged portion being opened once it has been closed.

Preferably the securing surface is a flat surface perpendicular to the substantially planar embracing portion.

Preferably the securing surface is substantially proximate to the receptacle portion.

Preferably the securing surface is substantially aligned with the receptacle portion.

Preferably the recess is concave in the plane of the attachment when the attachment is planar.

Preferably, the identification attachment is substantially planar.

Preferably the recess is substantially cylindrical.

Preferably the recess and/or recess closure member are provided with ridges arranged so as to provide friction between the sides of the recess and the closure portion to retain the closure member in the recess.

According to a second aspect of the present invention there is provided an identification attachment for a bottle having a neck, the identification attachment including:

a receptacle portion adapted to receive an electromagnetic identification tag;

a compressible element adapted to be received in a compressed state in the tag receptacle portion with the electromagnetic tag.

Preferably the identification attachment includes a compressible element adapted to be received in a compressed state in the receptacle portion with the electromagnetic identification tag.

Preferably the compressible element is adapted to substantially fill the portion of the recess not taken up by the electromagnetic identification tag.

Preferably the compressible element includes a foam material.

Preferably the compressible element includes a closed-cell foam material.

Those skilled in the art will be aware that an RFID tag may be formed by a coil connected by wires to a central electronic chip. Such a compressible element will tend to hold the coil and the electronic chip in a relatively fixed relationship with each other.

The compressible element will also give around the wires to allow them to have a relatively non-tortous path between the coil and the electronic chip.

According to a third aspect of the present invention there is provided an identification attachment for a bottle having a neck, the identification attachment including:

a receptacle portion adapted to receive an electro magnetic identification tag; and a filler element adapted to be received in the receptacle portion with an identification tag to reduce the volume of air in the receptacle portion around the identification tag.

By reducing the volume of air in the receptacle portion around the identification tag, the space filler element acts to minimise the amount of atmospheric moisture that may be present in the receptacle portion at the time it is sealed.

Preferably the space filler element is adapted to compress the identification tag against at least one wall of the receptacle portion.

Preferably the space filler element is adapted to support the identification tag.

Preferably the filler element may be adapted to compress both a coil and electronic chip of an identification tag against a wall of the receptacle portion.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
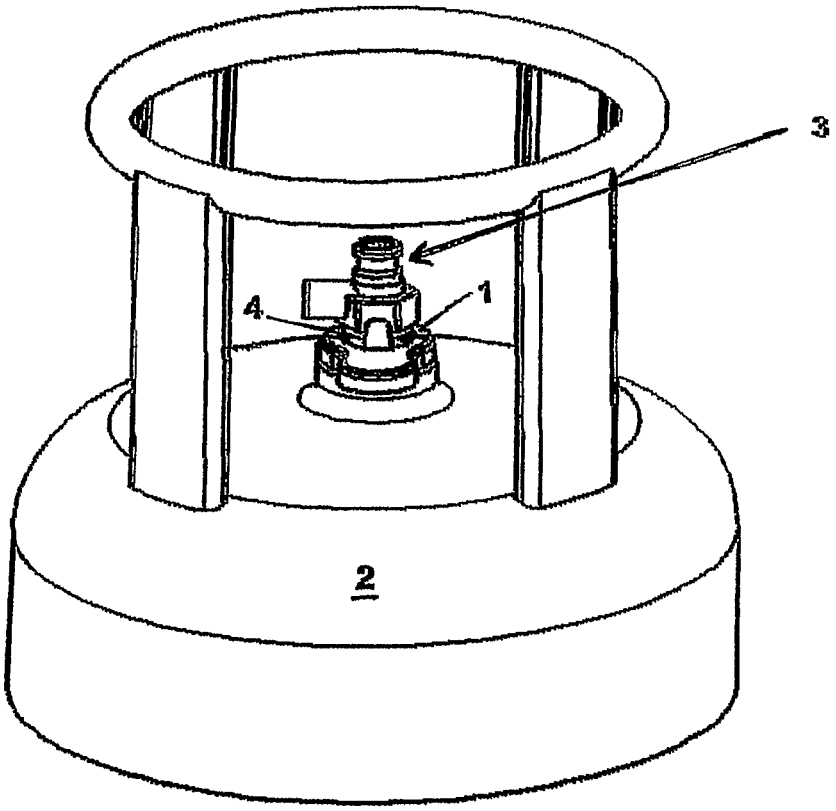
FIG. 1 shows a perspective view of a gas bottle which has a gas outlet fitting with an RFID tag attachment according to a preferred embodiment of the present invention.

FIG. 1 shows the identification attachment 1 as it might be used in conjunction with a radio frequency identification tag (not shown) to identify a bottle 2. In use, a Radio Frequency Identification Tag (RFID) would be received within the attachment 1 so that it is located in association with a part of the bottle 2 that is easily accessible. The outlet fitting 3 might be a suitable part. In this embodiment the tag is sealed with the attachment so that it is stored in an environmentally resistant condition.

To identify the gas bottle 2, a user waves a RFID tag reader (not shown) towards the attachment 1. The attachment 1 houses an RFID tag (not shown) from which is read an identification or inventory number.

The gas bottle 2 has an outlet valve 3 which has a neck 4 about which the attachment 1 is secured. This particular gas bottle has a number of flat surfaces 5 above the neck which are provided for use in tightening the valve 3 of the outlet 3 onto the bottle 2.

Figure 2:
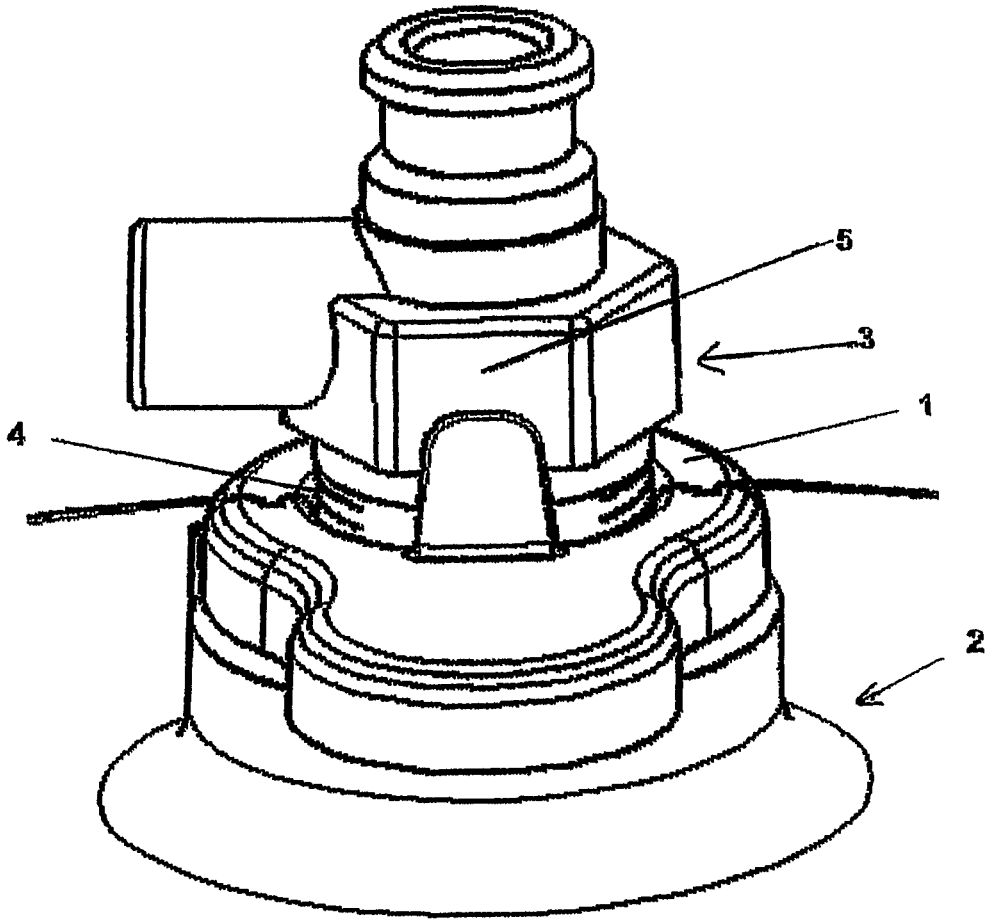
FIG. 2 shows a closer perspective view of the gas outlet fitting with RFID tag attachment according to the same preferred embodiment of the present invention as shown in FIG. 1.
Figure 3:
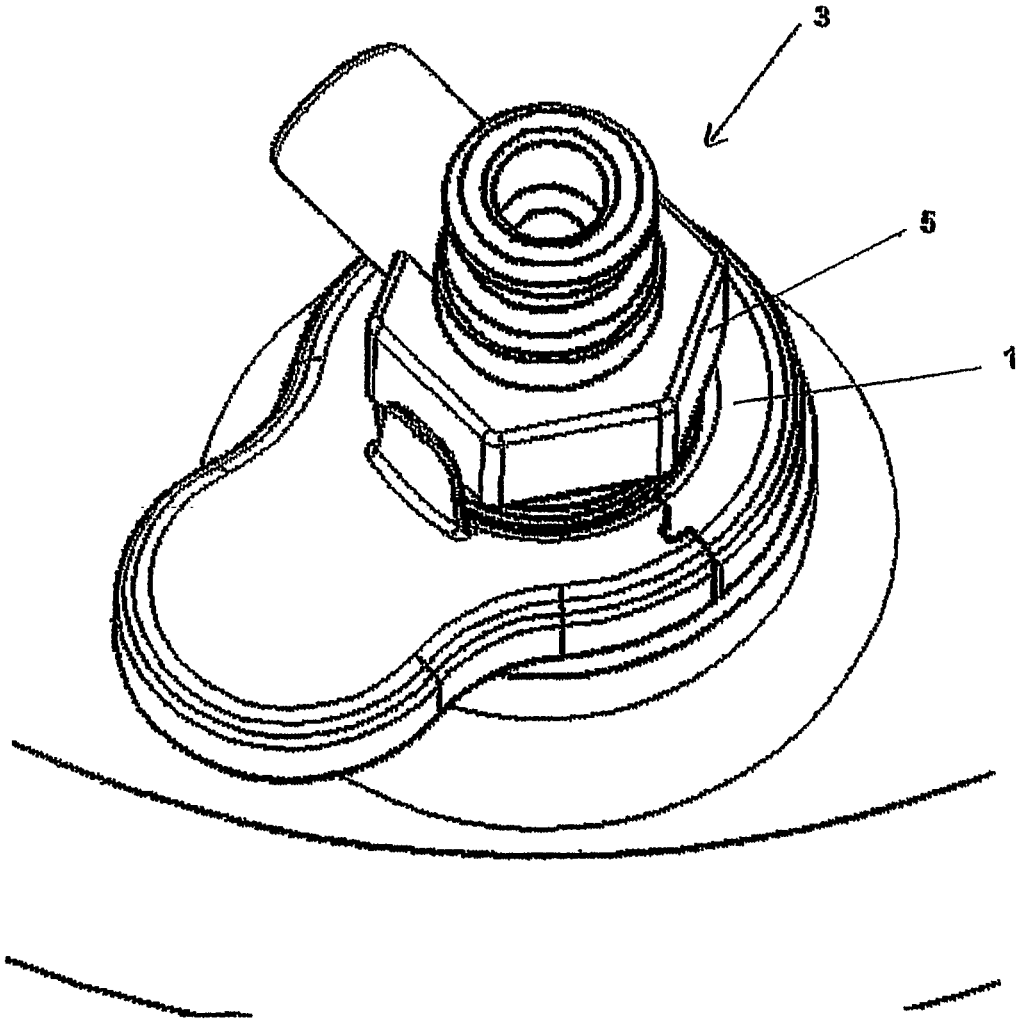
FIG. 3 shows an alternative perspective view of a gas outlet fitting with RFID attachment according to the same preferred embodiment of the present invention as shown in FIGS. 1 and 2.

FIGS. 2 and 3 show that the neck 4 is surrounded and/or embraced by the attachment 1 according to the preferred embodiment of the present invention. Alternative embodiments may possibly have the RFID tag attachment extending partially around the neck 4 of the bottle 2. FIGS. 2 and 3 also show that the RFID attachment engages, or bears against, one of the flat surfaces 5 of the outlet fitting 3 in such a manner that the attachment 1 would not easily move around the neck 4. This means that if a group of bottles 2 are stacked and stored in a given orientation, with the attachment towards an access area, the attachment 1 would remain in a position where it was accessible to the access area. This is provided the gas bottle 2 remained in the same orientation. This resistance to the attachment 1 moving around the neck allows the RFID tag to be located in a position where it is relatively accessible to the RFID tag reader. Otherwise, the metallic outlet fitting 3 might adversely affect radio frequency transmissions and interrupt identification readings.

FIGS. 2 and 3 show this embodiment as being planar so as to conveniently fit between the top of the bottle 2 and the flat surfaces 5 of the bottle 2.

Figure 4:
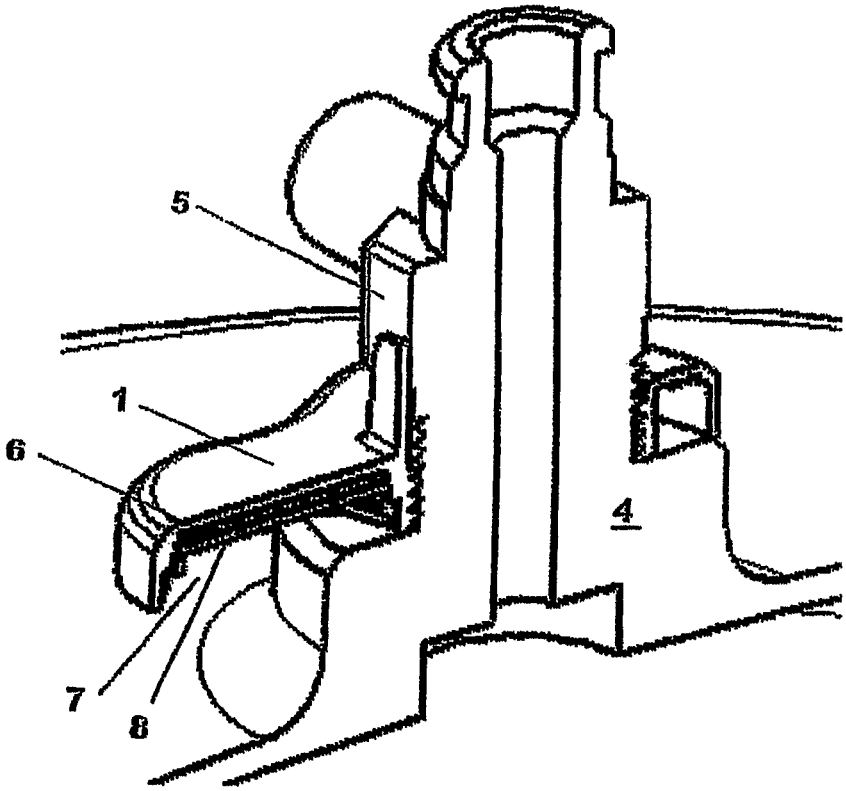
FIG. 4 shows a cutaway sectioned view of a gas outlet fitting with an RFID tag attachment according to the same preferred embodiment as shown in FIGS. 1 to 3.

FIG. 4 shows a cross-section of the RFID attachment 1 and neck 4. FIG. 4 shows a receptacle portion 6 for an RFID tag (not shown). The receptacle portion 6 is canti-levered from the neck 4 when the attachment 1 embraces the neck 4.

Figure 5:
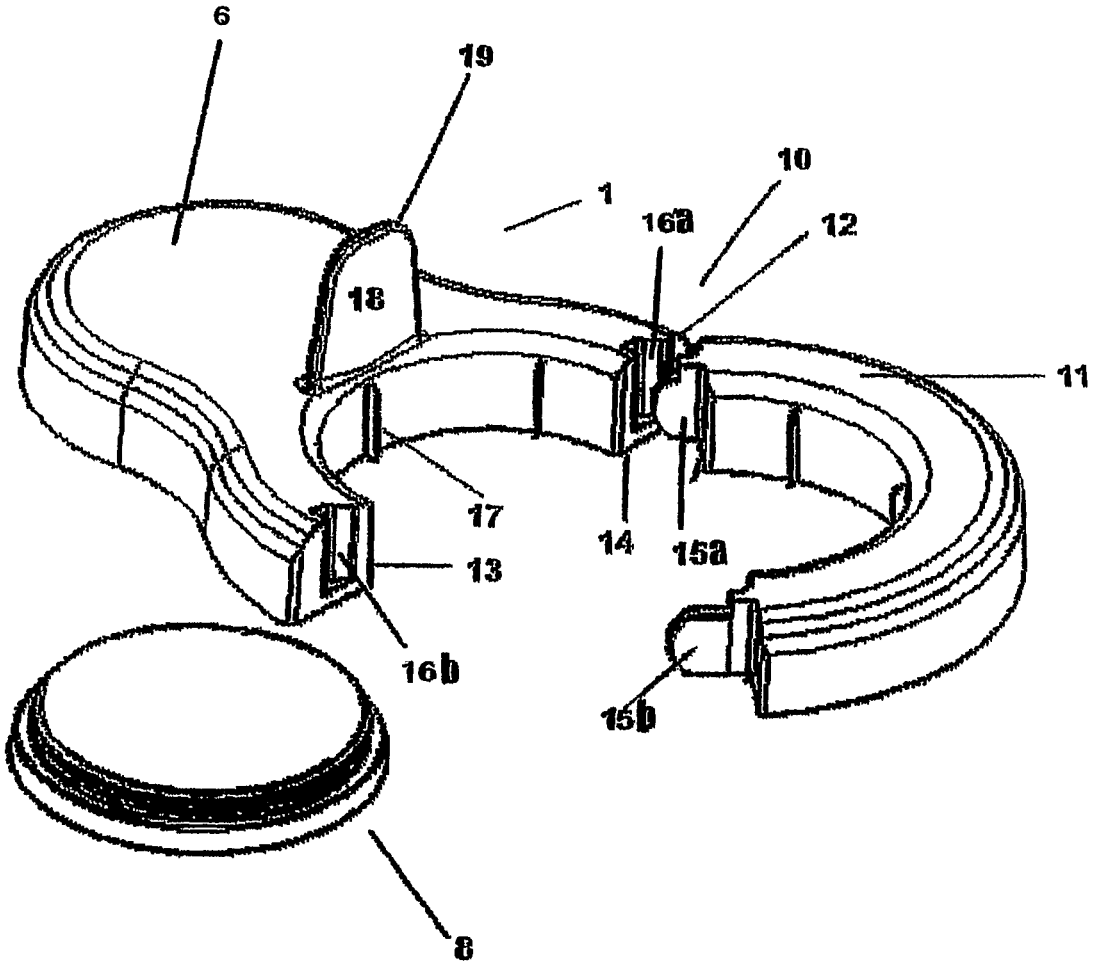
FIG. 5 shows an exploded perspective of an RFID tag attachment according to the same preferred embodiment of the present invention as shown in FIGS. 1 to 4.

FIG. 5 shows an exploded perspective view of an attachment 1 according to a preferred embodiment of the present invention.

The RFID attachment 1 has an embracing portion 10 which embraces the neck 4 of the bottle 2 and provides support for the receptacle portion 6 to cantilever from the neck 4.

The receptacle portion 6 provides a recess 7 which is closed by a closure member or cap 8. The closure member has a co-operating shape with the inside of the recess 7 and is inserted or pressed into the recess 7 to seal the receptacle portion 6. The recess 7 and enclosure 8 have co-operating shapes or profiles. The materials of the recess 7 and/or closure 8 are relatively resilient so the receptacle portion 6 is sealed within the receptacle. This protects the RFID tag (not shown) against potentially adverse environmental conditions. Suitable materials and co-operating profiles of recess 7 and closure 8 will be apparent to those skilled in the art.

In this embodiment, the recess 7 is formed on the underside of the receptacle portion 6. The receptacle portion 6 protrudes from an embracing portion 10 which (as shown in FIGS. 1 to 4) embraces the neck 4 of the outlet fixture 3.

FIG. 5 also shows the side profile of the closure 8 of the recess 7. This profile shows that a tortuous path would be formed between the inside of the recess 7 and the outside of the closure 8. As will be apparent to those skilled in the art, this tortuous path assists in retaining and sealing the closure 8 in the recess 7. The profile of the recess 7 or cap closure 8 can be formed with circumferential ridges which further assist in the sealing of the closure 8 in the recess 7 and/or assist in retaining the closure 8 in the recess 7. Complimentary surfaces other than ridges which perform the same function may be apparent to those skilled in the art.

As shown in FIG. 5, the embracing portion 10 of this preferred embodiment has a hinged portion 11 connected to the rest of the embracing portion 10 by a hinge 12.

Preferably, this hinge 12 is simply formed from a web of material joining the hinged portion 11 to the rest of the embracing portion.

Contact portions 13, 14 of the embracing portion 10 may be formed with latches or cooperating clip features 15*a*, 15*b*, 16*a* and 16*b*. This allows the hinged portion 11 to be securely closed around a neck 4 of the outlet fitting 3. In this embodiment, the latching clip features 15, 16 can be formed so as to prevent the latching clip and hinged portion 11 being opened, once it had been closed against the rest of the attachment 1, without damaging the latches 15 and 16. This provides an anti-tamper measure for the attachment 1.

A number of thread engaging portions in the form of filaments, protrusions, or ridges 17 are formed on the inside of the embracing portion 10. The filaments 17 are (by choice of materials and their profile) easily formed by the material of the thread on the neck 4 of an outlet fitting 3. This deformation would resist rotation of the attachment 1 about the neck 4. Deformation occurs due to pressure supplied by the enhancing portion 11. It will be apparent to those skilled in the art that this pressure may be supplied initially by an operator and then maintained by the embracing portion 11.

The attachment 1 also has a contact surface 18 provided on a protrusion 19 which extends up from the rest of the attachment 1. FIG. 5 shows the protrusion 19 located proximate the receptacle portion 6 and aligned with the receptacle portion 6 in terms of it's position around the embracing portion 10.

FIG. 3 shows the contact surface 18 provided by the protrusion 19 bears against one of the surfaces 5 on the outlet fitting 3 which are usually provided to facilitate tightening of the outlet fitting 3. The action of the surface 18 bearing against surface 5 resists rotation of the attachment 1 around the neck 4.

The action of the filaments 17 and contact surface 18 means that the RFID tag housed in the receptacle portion 6 will maintain a constant orientation with the bottle 2. This avoids obstruction or interference with the radio frequency transmissions used by the RFID tag (not shown) and RFID tag reader (not shown).

To place an RFID tag in the receptacle portion 6 the attachment 1 can be turned upside down (as compared to FIG. 5) and an RFID tag (not shown) placed in recess 7. The closure 8 might then be placed in the recess and pressed in place either by hand or with a press jig. The closure 8 may be sonically welded in place.

The RFID Tag attachment 1 can then be taken to a gas bottle 2 and the hinged portion 11 opened at the hinge 12 and closed around the neck 4 thus embracing the neck. The hinged portion can then be closed by pressing the hinged portion towards the rest of the RFID tag attachment 1 so that the latching clip features 15 and 16 lock together to form a closure for the hinged portion 11.

In this step of closing the embracing portion 10 about the neck 4, filaments 17 would likely have been deformed by the thread on the neck 4. At the same time the contact surface 18 would bear against the flat surface 5 of the outlet fitting 3. Both of these measures would provide an effective resistance to the RFID attachment 1 moving around the neck of the neck 4 to a position where radio frequency waves might be inhibited or interfered with and reading of the RFID tag affected. Alternative embodiments include only one or other of these measures.

The identification attachment 1 is typically formed by an injection moulded plastics. The identification attachment might be formed in two parts, with the recess closure member 8 and the rest of the identification attachment 1 being formed separately.

Figure 6:
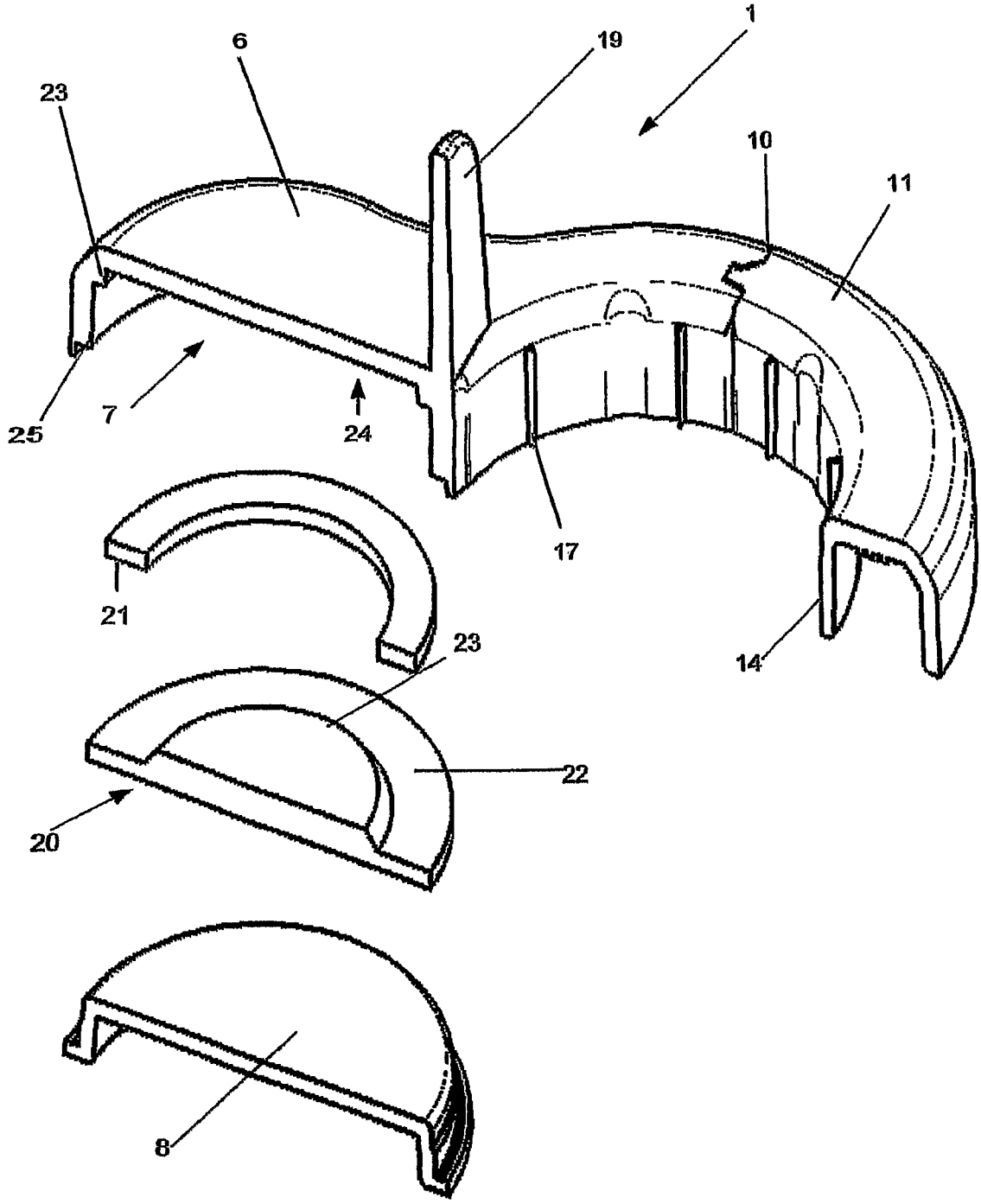
FIG. 6 shows an exploded cross section view of a second embodiment of the present invention which incorporates a compressible element.

FIG. 6 shows a further embodiment of the present invention which consists of an identification attachment 1 according to the same preferred embodiment as FIGS. 1 to 5 with the inclusion of a compressible element 20.

Also shown in FIG. 6, for reference, is a representation of the coil of a typical RFID tag 21.

FIG. 6 shows all of the parts employed to form the identification attachment in cross section in an 'exploded' view.

FIG. 6 shows the elements in this embodiment of the identification attachment 1 in the order they would be assembled. Immediately below the recess 7 formed in the identification attachment 1 is the identification tag 21. Shown below that is a compressible element 20 shown in a compressed state as it would be when the identification attachment 1 is fully assembled. Below the compressible element 20 is shown the recess closure 8.

The compressible element 20, in the compressed state, has a substantially annular region 22 aligned with the identification tag 21, where the compressible element 20 is highly compressed. Within the annular region 22 is a relatively uncompressed, region 29 which is aligned with the opening in the middle of the identification tag coil 21. This region 29 may, in some embodiments, be entirely uncompressed.

The identification attachment 1 shown in FIG. 6 is assembled by placing the identification tag 21 in the recess 7, followed by the compressible element 20 and finally by the closure member 8.

The closure member 8 would be inserted into the recess with enough force to compress the compressible element 20 against the identification tag 21. The recess closure 8 may then be sonically welded to the receptacle portion 6 of the identification attachment 1. Other suitable forms of welding will be known to those skilled in the art.

Figure 7:
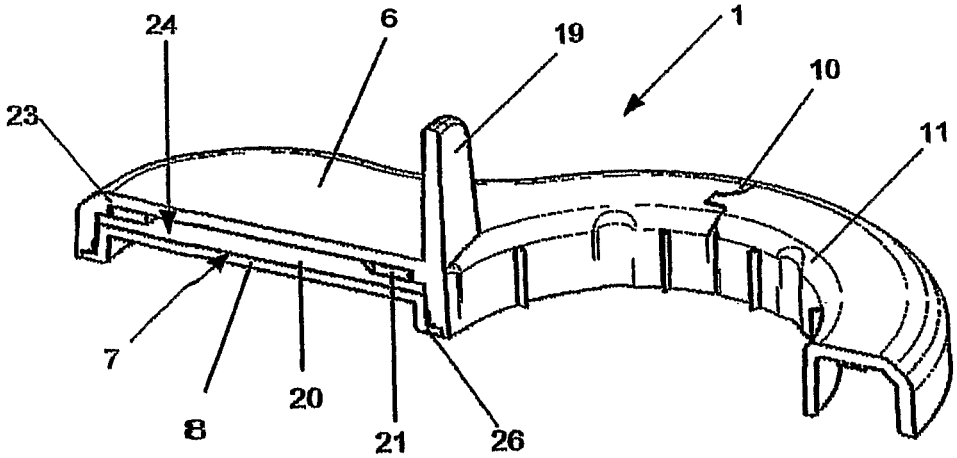
FIG. 7 shows the identification attachment according to the second embodiment shown in FIG. 6 when fully assembled.

FIG. 7 shows the second embodiment of the identification attachment 1 in an assembled state.

Referring to FIG. 7, a protrusion 23 is provided in the recess 7 to form a inner recess 24 which the identification tag 21 will fit. Typically, the inner recess 24 will have a depth and diameter corresponding to the thickness and diameter of the identification tag 21. The protrusion 23 acts to locate the tag in the recess 7. The protrusion 23 also acts to limit movement of the recess closure member 8 into the recess 7.

FIGS. 6 and 7 also show an outer recess 25 and a corresponding flange 26 formed on the receptacle closure 8. These limit movement of the receptacle closure 8 into the recess 7. The identification tag 21 is compressed against a wall of the inner recess 24 by the compressible element 20 which is in turn compressed by the receptacle closure 8. The action of the inner recess 24, outer recess 25, and flange 26 prevent the recess closure 8 directly compressing the identification tag 21. Therefore, in this embodiment, pressure on the identification tag is only provided by the compressible element 20.

The thickness of the compressible element 20 and choice in material will determine the degree of pressure between the identification tag and the inner recess 24. Various embodiments may have various combinations of thickness and materials. Compression of the identification tag into the inner recess 24 will tend to minimise the affects of vibration or rattle of the identification tag 21 in the recess 7.

Figure 8:
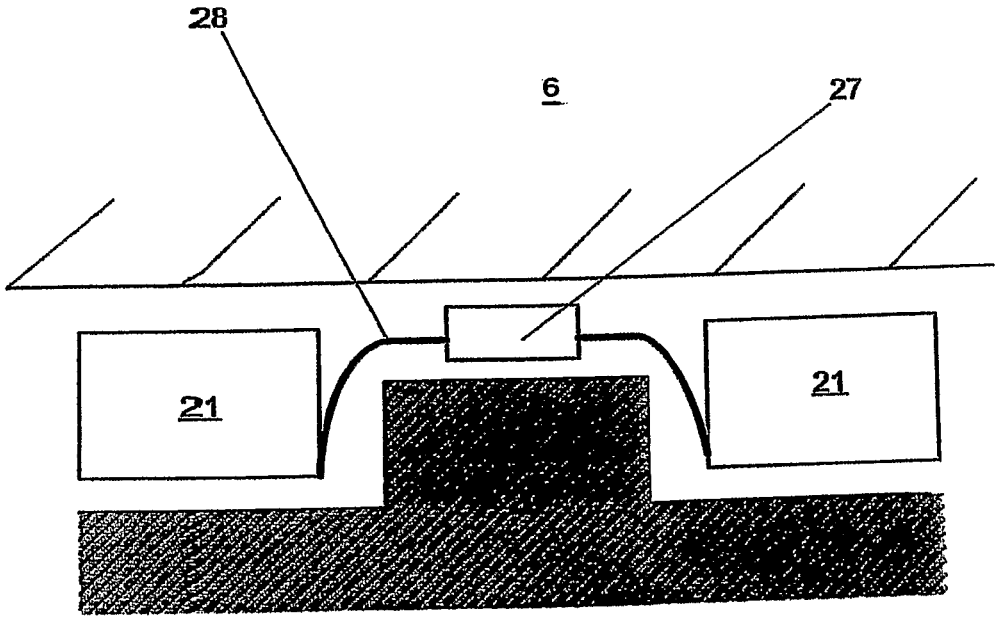
FIG. 8 shows a cross section view of an identification tag received in the identification attachment according to the second embodiment as shown in FIGS. 6 and 7.

FIGS. 7 and 8 show that the compressible element 20 effectively fills the regions of the recess 7 not taken up by the identification tag 21. This minimises the amount of atmospheric moisture which is eventually trapped into the recess 7 when the closure member 8 is fitted and typically welded to the identification attachment 1. The adverse affects of atmospheric moisture on RFID tags is well known to those skilled in the art.

FIG. 8 shows a cross sectional view of an identification tag received in a receptacle portion 6 of an identification attachment according to a second embodiment of the present invention. In this case an electronic chip 27 and wires 28 of a typical RFID tag are depicted. Above the identification tag is depicted a wall of the receptacle portion 6 of the identification attachment 1 and below it is depicted the compressible element 20.

FIG. 8 shows the wires 28 compressed upwards by the compressible element 20 and the electronic chip 27 compressed against the wall of the receptacle portion 6.

The wires 28 are stretched towards the wall of the receptacle portion 6. In this configuration they will have a relatively untwisted or non-tortuous path and will be held relatively stable. Those skilled in the art will appreciate the benefits of avoiding tortuous paths in the wires 28 and the advantages of holding the wires 28 stable.

The identification attachment described herein provides a convenient sealed receptacle portion 6 for a RFID tag 21 which is easily clipped about the neck 4 and maintains a constant orientation with that bottle to facilitate easy reading of the RFID tag.

The sealed receptacle portion 6 also provides the RFID tag 21 with protection from potential damage during handling of gas bottles 2.

The compressible element 20 and the shape of the recess 7, with inner recess, minimises damage to the RFID tag through shock or vibration during transportation of bottles, in addition to minimising atmospheric moisture.

FIG. 9 and FIGS. 10 to 12 show identification attachments according to further embodiments of the present invention. These embodiments resemble the preferred embodiments shown in FIGS. 1 to 5 and FIGS. 6 to 8 with the exception that they do not have a thread engaging element in the form of a filament 17 which deforms to the profile of a thread in use.

Figure 9:
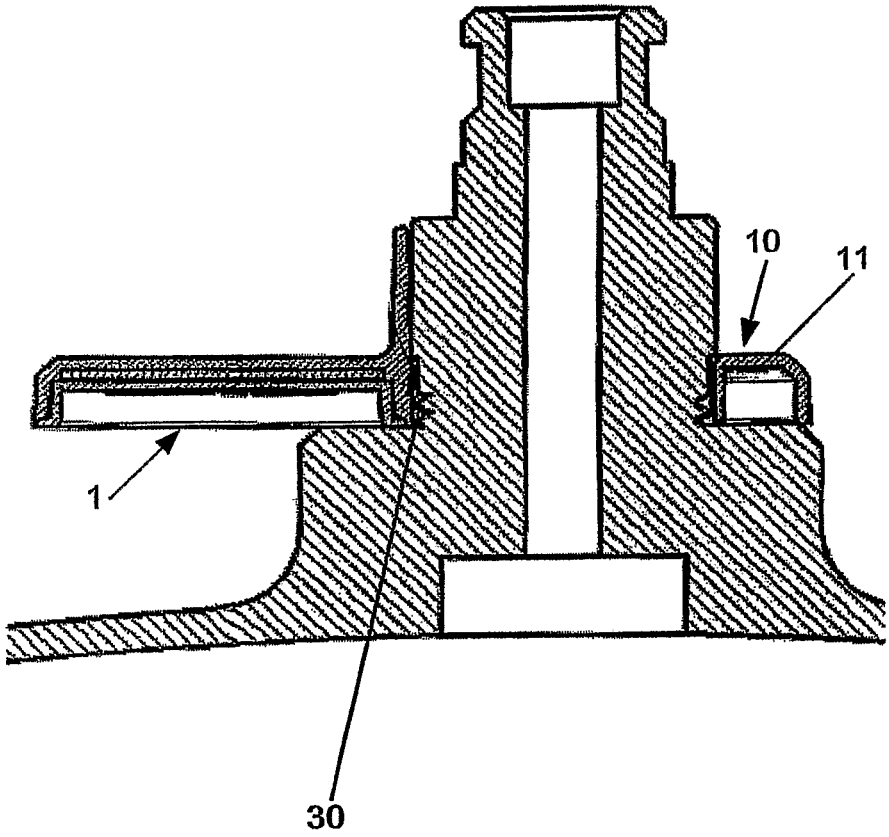
FIG. 9 shows a cross section view of an identification attachment according to a third embodiment of the present invention, the identification attachment is shown attached to the neck of a bottle.
Figure 10:
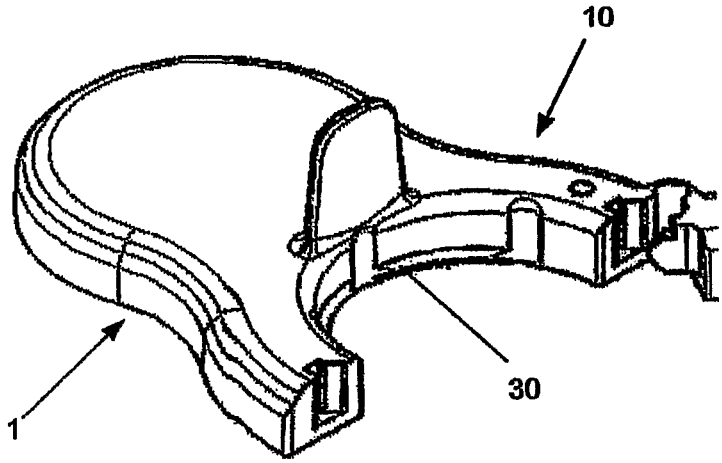
FIG. 10 shows a close up perspective view of the identification attachment according a fourth alternative embodiment of the present invention.

In place of or in addition to the filament 17 the embodiments shown in FIGS. 9 and 10 have thread engaging elements in the form of projections 30 formed on the embracing portion 10 on a surface that contacts the neck of the bottle. The projections 30 extend towards the neck 4 of the bottle when the embracing portion embraces the neck 4. It will be apparent to those skilled in the art that both forms of thread engaging element may be used in combination. Other embodiments may have both thread engaging projections 30 and deformable filaments 17 spaced about the embracing portion 10.

The projection 30 is shown extending substantially circumferentially with respect to the inside surface of the embracing portion 10. It will be apparent to those skilled in the art that a circumferentially extending projection 30 will be approximately aligned with a thread formed on the neck 4 of a bottle 2.

The embodiment shown in FIG. 9 differs from that shown in FIG. 10 in that it has two parallel sets of projections 30.

Figure 11:
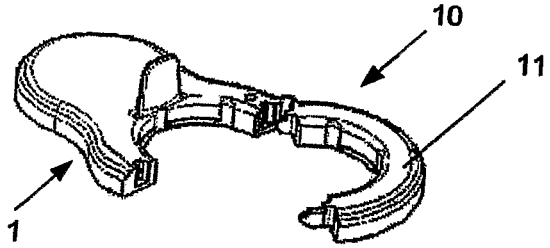
FIG. 11 shows a wider perspective view of the identification attachment according to the fourth embodiment shown in FIG. 10.
Figure 12:
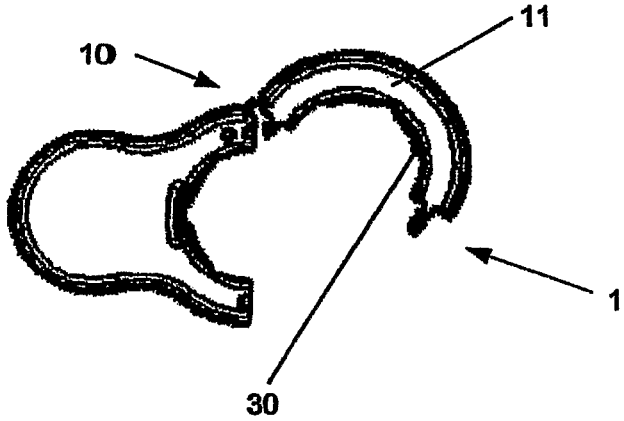
FIG. 12 shows a birds eye view of the identification attachment according to the fourth embodiment shown in FIGS. 10 and 11.

FIGS. 11 and 12 show a plurality of the thread engaging elements disposed about the embracing portion 10.

The thread engaging projections 30 act to resist the identification attachment 1 being lifted or pried from the neck 4. This provides an anti-tamper advantage additional to that already provided by the anti-tamper closures for the hinged portion 11.

The thread engaging projections 30 also act to frictionally engage a thread on the neck 4 of a bottle 2. This assists in resisting rotation of the attachment 1 about the neck 4. Additionally, the thread engaging portion assists in securing the attachment 1 at one end of the neck 4 and against the top of the bottle. This is achieved by the thread on the bottle guiding the projection 30 down towards the bottle 2.

In the preferred embodiment the attachment 1 is formed from polypropylene. Polypropylene provides a low density resin that offers a good balance of thermal, chemical and electrical properties of advantage in this application. In particular, polypropeline is transparent to radio frequency radiation. Polypropeline also provides moderate strength at a moderate cost. It is envisioned that other embodiments may use other materials that are sufficiently transparent to radio frequency waves.

The process of reading inventory numbers from RFID tags associated with bottles has the advantage of being quick to get a reading. It also has the advantage of having the reading being automatically in electronic form where it might be downloaded or uploaded to an inventory system, for example.

The identification attachment of the preferred embodiments described herein provide a convenient and cost effective means to mount an RFID tag onto the necks of bottles. They provide the particular advantage of mounting the tag on a metallic neck in a position which is favourable for an RFID reader.

The embodiments described also provide anti-tamper advantages to mounting RFID tags.

Aspects of the present invention have been described by way of example only and it should be appreciated that modifications and additions may be made thereto without departing from the scope thereof as defined in the appended claims.

What we claim is:

1. An identification attachment for attaching an electromagnetic identification tag to a bottle having a neck, the identification attachment comprising:

a receptacle portion adapted to receive an electromagnetic identification tag;

an embracing portion connected to the receptacle portion and having a through hole that has an axis and is adapted to embrace a neck of a bottle so as to mount the receptacle portion onto the neck of the bottle, wherein the receptacle portion is substantially canti-levered from the embracing portion when the embracing portion embraces the neck of a bottle; and a closure member engageable with the receptacle portion for sealing the electromagnetic identification tag in the receptacle portion, wherein the closure member is engageable with the receptacle portion from below in the direction of the longitudinal axis of the through hole.

2. The identification attachment of claim 1, further comprising a hinged portion attachable to the embracing portion to allow the embracing portion to open and to allow the neck of the bottle to be embraced by the embracing portion.

3. The identification attachment of claim 2, wherein the embracing portion includes a hinge closure for allowing the embracing portion to be closed.

4. The identification attachment of claim 3, wherein the hinge closure is adapted to provide tamper evident closure of the hinged portion.

5. The identification attachment of claim 3, wherein the hinge closure includes at least one latch.

6. The identification attachment of claim 5, wherein the hinge closure includes at least one latch located at an end of the hinged portion.

7. An identification attachment for attaching an electromagnetic identification tag to a bottle having a neck, the identification attachment comprising:

a receptacle portion adapted to receive an electromagnetic identification tag;

an embracing portion connected to the receptacle portion and adapted to embrace a neck of a bottle so as to mount the receptacle portion onto the neck of the bottle, wherein the receptacle portion is substantially canti-levered from the embracing portion when the embracing portion embraces the neck of a bottle;

a closure member engageable with the receptacle portion for sealing the electromagnetic identification tag in the receptacle portion; and a protrusion having a flat securing surface adapted to bear against and to be substantially parallel to a flat surface of the neck of the bottle for securing the identification attachment against rotation around the neck of the bottle, wherein the embracing portion has a top surface and defines a through hole which has an axis and is adapted to receive the neck of the bottle, and the protrusion is outwardly spaced from an innermost surface of the embracing portion and projects upwardly from the top surface of the embracing portion and parallel with the axis of the through hole, and an entirety of the closure member is covered by the receptacle portion from above when the closure member is engaged with the receptacle portion and the axis of the through hole is oriented vertically.

8. The identification attachment of claim 7, wherein the protrusion is arranged substantially perpendicular to the top surface of the embracing portion.

9. The identification attachment of claim 1, wherein the receptacle portion defines a recess, and the closure member is adapted to be inserted into the recess so as to close the recess.

10. The identification attachment of claim 9, wherein the recess is substantially cylindrical.

11. The identification attachment of claim 9, wherein the closure member is adapted to be pressed into the recess.

12. The identification attachment of claim 9, wherein at least one of the recess and closure member has at least one ridge.

13. The identification attachment of claim 12, wherein the at least one ridge is arranged so as to provide friction between of the recess and the closure member in the recess.

14. The identification attachment of claim 1, further comprising at least one thread engaging element adapted to engage a thread on the neck of the bottle with the identification attachment.

15. The identification attachment of claim 14, wherein the thread engaging element is formed on the embracing portion.

16. The identification attachment of claim 14, further comprising a plurality of thread engaging elements disposed along an inner surface of the embracing portion.

17. The identification attachment of claim 14, wherein the at least one thread engaging element includes at least one thread engaging projection which projects towards the neck of the bottle in use.

18. The identification attachment of claim 17, wherein the at least one thread engaging projection is substantially aligned with a thread on the neck of the bottle.

19. The identification attachment of claim 14, wherein the at least one thread engaging element includes at least one filament arranged to bear against the neck of the bottle in use.

20. The identification attachment of claim 19, wherein said at least one filament is deformable to a profile of the neck with pressure provided by the embracing portion.

21. The identification attachment of claim 20, wherein the filament is deformable to a longitudinal profile of the neck of the bottle.

22. The identification attachment of claim 19, wherein the at least one filament is formed as a ridge on an inner surface of the embracing portion.

23. The identification attachment of claim 1, further comprising a compressible element adapted to be received in the receptacle portion with the electromagnetic identification tag.

24. The identification attachment of claim 23, wherein the compressible element is adapted to be compressed to substantially fill parts of the receptacle portion not filled by the electromagnetic identification tag.

25. The identification attachment as claimed in claim 1, wherein the receptacle portion is formed substantially from plastic material.

26. The identification attachment of claim 1, wherein the receptacle portion is adapted to receive the electromagnetic identification tag in the form of a radio frequency identification tag.

27. The identification attachment of claim 1, wherein the recess includes at least one protrusion adapted to locate the electromagnetic identification tag in the recess.

28. The identification attachment of claim 27, wherein the at least one protrusion is adapted to limit movement of the closure member into the recess.

29. The identification attachment of claim 1, wherein at least a portion of the identification attachment is formed from material that is substantially transparent to radio frequency radiation.

30. The identification attachment of claim 1, wherein an entirety of the closure member is covered by the receptacle portion from above when the closure member is engaged with the receptacle portion and the axis of the through hole is oriented vertically.

31. The identification attachment of claim 1, wherein the receptacle portion has a recess with an opening on a bottom surface of the receptacle portion, the closure member configured to close the opening of the receptacle portion, the recess is adapted to receive the electromagnetic identification tag therein, the receptacle portion further has a top surface opposite to the bottom surface in a direction of the axis of the through hole; and the identification attachment further comprises a securing surface projecting upwardly from the top surface of the receptacle portion in the direction of the axis to bear against the neck of the bottle for securing the identification attachment against rotation around the neck of the bottle.

32. The identification attachment of claim 7, wherein the securing surface of the protrusion is a planar securing surface.

33. The identification attachment of claim 31, wherein the securing surface of the protrusion is a planar securing surface.

34. An identification attachment for attaching an electromagnetic identification tag to a bottle having a neck, the identification attachment comprising:

a receptacle portion adapted to receive an electromagnetic identification tag;

an embracing portion connected to the receptacle portion and having a through hole that has an axis and is adapted to embrace a neck of a bottle so as to mount the receptacle portion onto the neck of the bottle, wherein the receptacle portion is substantially canti-levered from the embracing portion when the embracing portion embraces the neck of a bottle; and a closure member engageable with the receptacle portion for sealing the electromagnetic identification tag in the receptacle portion, wherein the closure member is below the receptacle portion when the axis of the through hole is oriented vertically, and wherein the closure member is configured to be prevented, by a shoulder of the bottle, from being removed from the receptacle portion when the embracing portion embraces the neck of the bottle.

35. An identification attachment for attaching an electromagnetic identification tag to a bottle having a neck, the identification attachment comprising:

a receptacle portion adapted to receive an electromagnetic identification tag;

an embracing portion connected to the receptacle portion and having a through hole that has an axis and is adapted to embrace a neck of a bottle so as to mount the receptacle portion onto the neck of the bottle, wherein the receptacle portion is substantially canti-levered from the embracing portion when the embracing portion embraces the neck of a bottle; and a closure member engageable with the receptacle portion for sealing the electromagnetic identification tag in the receptacle portion, wherein the receptacle portion includes an opening that receives the closure member, wherein a longitudinal axis of the opening is at least generally parallel with a longitudinal axis of the through hole of the embracing portion.

* * * * *